United States Patent [19]

Karlsson et al.

[11] Patent Number: 4,602,410

[45] Date of Patent: Jul. 29, 1986

[54] GUIDE VANE RING FOR A RETURN FLOW PASSAGE IN AXIAL FANS AND A METHOD OF PRODUCING IT

[75] Inventors: Sune Karlsson; Torvald Holmkvist, both of Växjö, Sweden

[73] Assignee: Flakt AB, Stockholm, Sweden

[21] Appl. No.: 589,890

[22] Filed: Mar. 15, 1984

[30] Foreign Application Priority Data

Mar. 18, 1983 [SE] Sweden ..... 8301497

[51] Int. Cl.[4] ..... B23P 15/02

[52] U.S. Cl. ..... 29/156.8 B; 416/223 R; 416/DIG. 3; 72/335

[58] Field of Search ..... 29/156.8 B; 239/399, 239/406, 380, 383; 415/52; 72/335; 416/223 R, DIG. 3

[56] References Cited

U.S. PATENT DOCUMENTS

| | | | |
|---|---|---|---|
| 2,431,647 | 11/1947 | Mayne et al. | 29/156.8 CF |
| 2,958,459 | 11/1960 | Newton et al. | 29/156.8 CF |
| 3,041,709 | 7/1962 | Friedman et al. | 29/156.8 CF |
| 3,189,260 | 6/1965 | Ivanov | 415/191 |

FOREIGN PATENT DOCUMENTS

| | | |
|---|---|---|
| WO82/01919 | 6/1982 | PCT Int'l Appl. . |
| 971445 | 9/1964 | United Kingdom . |

OTHER PUBLICATIONS

VGB Kraft Werktechnik 47, Heft. 3, Mar. 1977, pp. 159–165.

Leaflet of KKK (AG Kuhnle, Kopp & Kausch, Frankenthal) Oct. 1, 1977.

Pack, W. W.; Ivanov, S. K.; and Wereschtschagin, W. P.; Moskau 1974 (USSR Publishing House "Nedra") pp. 98–107.

*Primary Examiner*—Howard N. Goldberg
*Assistant Examiner*—Leonard S. Selman
*Attorney, Agent, or Firm*—Dann, Dorfman, Herrell and Skillman

[57] ABSTRACT

A guide vane ring for a return flow passage in axial fans comprises a ring (3) intended for placing in the return flow passage (4) coaxial with the impeller (6). A plurality of guide vanes (7) are formed integral with the ring and distributed round its exterior circumference. In a method of producing such a ring integral with its vanes, separate longitudinal slits are formed in a line one after the other in a metal strip. A cut is made transverse the strip between one end of each slit and one long edge of the strip. Portions of the band thus cut free are bent out from its plane and formed to a desired configuration, whereafter the formed band portions are bent such that the transverse cut lines will extend substantially at right-angles to the unformed flat band portion. This flat band portion is cut to desired length, formed and joined together into a circular ring with the portions formed to desired configuration forming exterior, substantially axially disposed guide vanes.

7 Claims, 7 Drawing Figures

Figure 1:
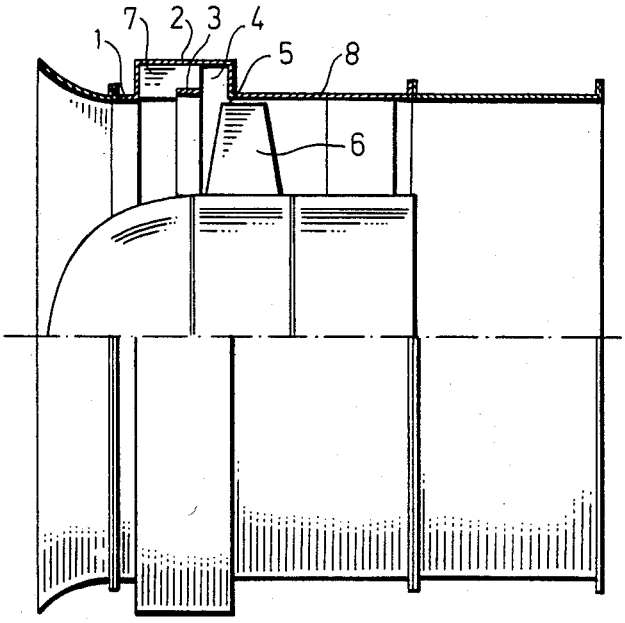

GUIDE VANE RING FOR A RETURN FLOW PASSAGE IN AXIAL FANS AND A METHOD OF PRODUCING IT

The present invention relates to a guide vane ring for a return flow passage in axial fans and a method of producing it.

The stable working range of axial fans is limited in relation to the pressure rise across the fan by the unstable region, which is the boundary against the unstable operating range. In the unstable range, the fan and associated systems often work with large variations in pressure, delivered volume and power. The axial fan must therefore be selected or controlled such that envisaged working points are within the stable range and have a margin to the unstable region.

It is known in the prior art that the stable working range can be substantially expanded by placing in the main flow, upstream of the impeller, an annular return flow passage which stabilizes the return flow from the impeller tips during operation in the unstable region. In such a case, to eliminate the need of diffusion vanes or guide vane means in the main flow, immediately upstream of the impeller, it is also known to mount guide vanes in the return flow passage, e.g. according to VGB Kraftwerkstechnik 57, Heft 3, March 1977, pages 159–165. By suitable implementation and location of the vanes, the recirculated air from the impeller tips during operation in the unstable region can be led off, redirected and effectively stabilized as well as having had given to it a desired pre-rotation, so that the efficiency of the fan is not reduced.

The procedure for this has so far been to individually weld each guide vane onto the interior of the return flow passage casing, which has been a complicated time—and costdemanding method.

The object of the present invention is to eliminate this disadvantage in the previously known art.

This object is achieved with a guide vane ring intended for being placed in the return flow passage coaxial with the impeller and integral with a plurality of guide vanes formed on the outer circumference of the ring, and with a method of producing such a ring wherein separate, longitudinally oriented slits are made in a metal strip, and a cut is made transversely to the strip, between one end of each slit and one long edge of the strip, the portions of the strip thus cut loose being bent out of the plane of the strip and formed to a desired configuration, subsequent to which said formed band portions are folded such that the transverse cut lines will extend substantially at right angles to the unformed flat strip portion, and in that this flat strip portion is cut to desired length, shaped and joined together to form a circular ring with the formed strip portions forming exterior guide vanes.

With the present invention there is achieved a guide vane ring, which is cheap to produce and simple to fit inside the return flow passage casing, since each vane is only fastened at its outer edge by one or more spot welds to the inside of the casing.

By the inventive method of forming the slits in the metal strip along a line at a greater distance from one long edge of the strip than the other, and by a transverse cut being made from one end of the slits to the edge of the strip through the wider strip portion, vanes are obtained with an axial length exceeding the width of the ring. There is thus obtained an extended portion of the vanes which can be used effectively for controlling the flow of the recirculated air in a desired manner.

Figure 2:
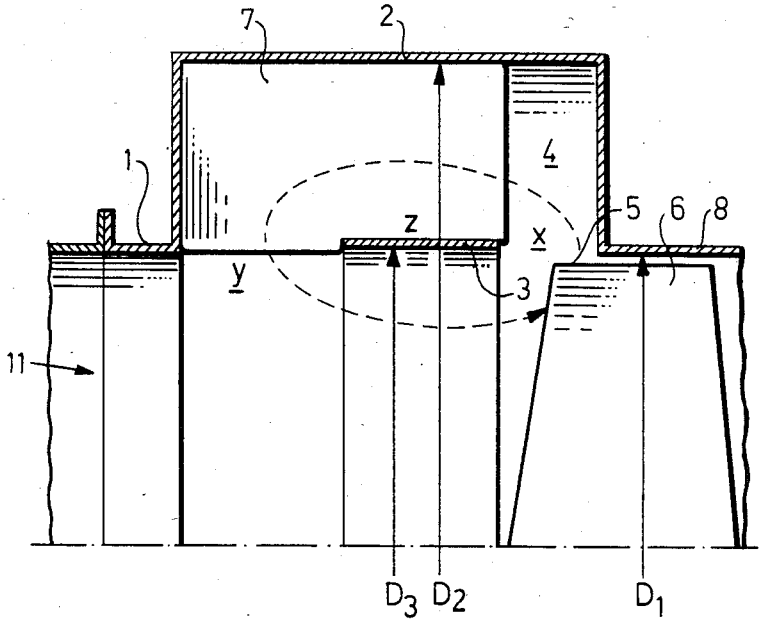
Figure 3:
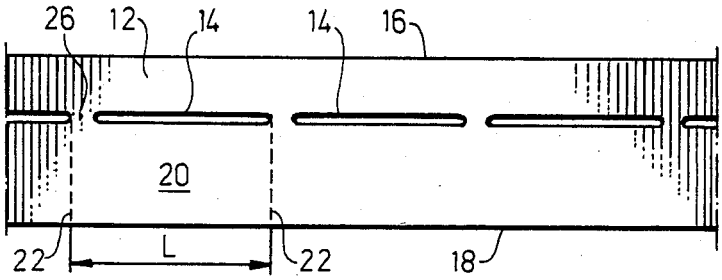
Figure 4:
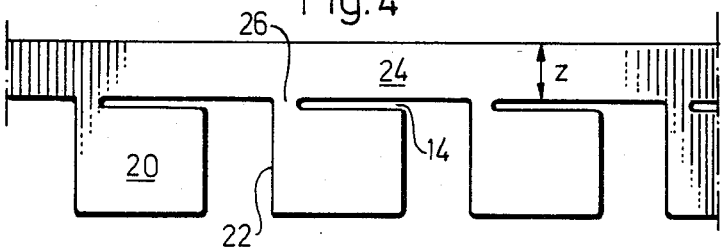
Figure 5:
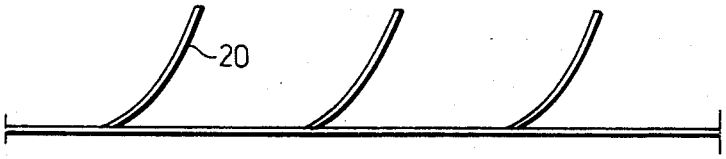
Figure 6:
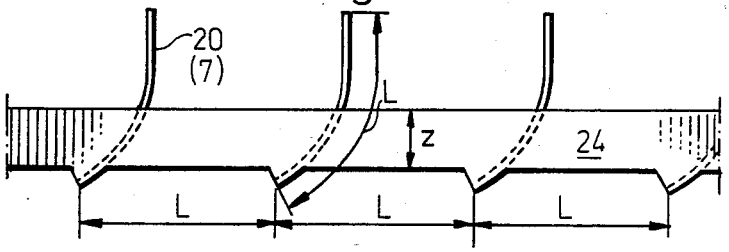
Figure 7:
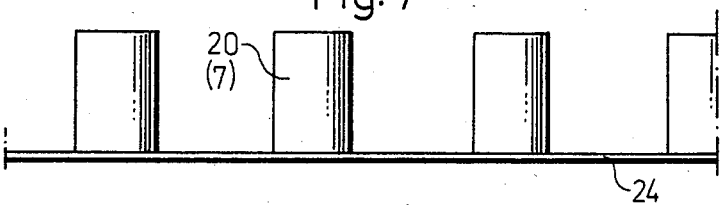

The invention will now be described in detail in conjunction with the appended drawings, on which FIG. 1 is a cross section through an axial fan, FIG. 2 is a fragmentary cross section through an annular return flow passage, FIG. 3 illustrates a metal strip serving as a blank in the production of a guide vane ring in accordance with the invention, FIG. 4 is the blank according to FIG. 3 after the cutting and forming step in the method according to the invention, FIG. 5 is a view of the blank at right angles to the view illustrated in FIG. 4, seen from above in FIG. 4, FIG. 6 is the same view as in FIG. 4, after a further bending step in the method according to the invention, and FIG. 7 is the same view as in FIG. 5 after this bending step.

An axial fan is illustrated in FIG. 1 and comprises an inlet part 1 and an impeller housing 8 in which an impeller 6 is disposed. Between the inlet part 1 and the impeller 6 a return flow passage 4 is disposed, which is defined by a circular casing 2. A circular ring 3 defines the passage 4 above the front edge 5 of the impeller blades. On the outside of the ring 3 there are a plurality of guide vanes 7 adapted with suitable spacing around the circumference of the ring. The recirculated air collected in the return flow passage 4 is returned through the inlet portion x and outlet portion y of the return flow passage to the main flow 11, and in towards the impeller 6, see FIG. 2.

As will be seen from FIG. 2, the guide vane ring is placed coaxially with the impeller 6. The diameter $D_1$ of the impeller housing is somewhat less than the diameter $D_3$ of the ring 3, typically 1–5%. The axially projected length $y+z$ of the guide vanes 7 exceeds the width z of the ring. By suitable configuration of this extended part of the guide vanes 7, the air flow can be guided in a desired manner on its return into the main flow 11.

FIGS. 3–7 are referred to for explaining the inventive method of production, different steps being illustrated in these Figures of an embodiment of the method in accordance with the invention.

A metal strip 12 is illustrated in FIG. 3, in which a plurality of longitudinal slits 14 are formed one after the other in a row. The slits 14 are formed at a greater distance from one long edge 18 of the strip 12.

A cut 22 is made from one end of each slit 14 to this long edge 18 of the strip 12, i.e. over the wider strip portion seen from the slits 14. The strip portion 20 thus cut free is bent downwards seen from the plan of the figure, adjacent the cut 22 and formed to desired configuration, see FIG. 4.

The strip of FIG. 4 is illustrated in FIG. 5 after this forming operation, in a view at right-angles to the one illustrated in FIG. 4 and seen from above in FIG. 4.

The band portion 20 thus formed into guide vanes 7 is subsequently formed or bent down below the flat unformed portion 24 of the strip 12 as seen in FIG. 4, the configuration illustrated in FIG. 6 thus being obtained. FIG. 7 is a view at right-angle from above of FIG. 6.

The flat continous band portion 24 is then cut to desired length for forming and joining into a circular ring 3, illustrated in FIG. 2, of desired diameter.

In fitting the thus obtained guide vane ring with the guide vane formed integrally with the ring, the portions 20 are each fixed at their outer edges to the inside of the casing 2 with the aid of one or more spot welds.

The slits 14 are made at such spacing from the edge 18 of the strip 12 that the height of the resulting guide vanes 7 is adjusted to the dimension $D_2$–$D_3$ of the flow return passage 4, see FIG. 2.

The total blank width of the metal strip 12 is equal to the width of the guide vane 7 (or the width of the strip portion 20) plus the slit width plus the width of the strip portion 24 which is equal to the width z of the ring 3.

The width of the slit can typically be of the order of magnitude 5 mm.

The length of the guide vanes L, see FIG. 6, is equal to the spacing between the slits 14. The guide vanes are formed such that the axial projection of the length L, which is approximately equal to z+y in FIG. 2, is adjusted to the dimensions of the casing 2.

The length of the slits 14 considerably exceeds the dimension of the strip portion 26 separating two successive slits.

In a typical example, the spacing between the slits, i.e. the length of the guide vanes L=110 mm and the length of the strip portion 26 is 10 mm. Guide vane rings with these dimensions are utilizable for fans with a diameter of 0.5 to 3.0 m. A guide vane ring for a fan with a diameter of 3.0 m thus includes 86 guide vanes distributed round the circumference at a spacing of 0.11 m. A guide vane ring for a fan of 2.0 m diameter contains 57 guide vanes, and a fan with a diameter of 0.5 m has 14 guide vanes. The number of guide vanes should not fall below this number, since aerodynamic disturbances in the return flow passage 4 can then easily occur.

Of course, the blank width of the strip 12, the length and width of the slits 14, the spacing L between the slits and the shape of the guide vanes 7 may be varied for adapting to different applications.

Since the number of guide vanes is normally in the region of 15–85, it will be understood that individual welding of each guide vane between ring and casing, as practiced in the prior art, results in considerable labour during assembly, the majority of which is eliminated with the present invention.

We claim:

1. Method of producing a guide vane ring for a return flow passage in axial fans, characterized in that separate, longitudinally oriented slits are made in a metal strip, a cut is made transversely to the strip, between each slit and one long edge of the strip, the portions of the stip thus cut loose being bent out of the plane of the strip and formed to a desired configuration, subsequent to which said formed band strip portions are folded such that the transverse cut lines will extend substantially at right-angles to the unformed flat strip portion, and in that said flat strip portion is cut to desired length, shaped and joined together to form a circular ring with the formed strip portions serving as exterior guide vanes.

2. Method as claimed in claim 1, characterized in that each slit is formed with a length considerably exceeding the length of the strip portion separating successive slits.

3. Method as claimed in claim 2, characterized in that the slits are formed with a length, which is approximately ten times the length of the separating strip portion.

4. Method as claimed in claim 1, characterized in that the slits are formed along a line at a greater distance from one longitudinal edge of the strip and that said transverse cut is made in the wider strip portion.

5. Method as claimed in claim 1, characterized in that the slit is formed with a width which is less than the length of the strip portion separating the successive slits.

6. Method according to claim 5 wherein the slit width is approximately one half the length of the strip portion separating the successive strips.

7. Method according to claim 1, characterized in that said cut is made between one end of each slit and one long edge of the strip.

* * * * *